US010053867B2

(12) United States Patent
Sinclair

(10) Patent No.: US 10,053,867 B2
(45) Date of Patent: Aug. 21, 2018

(54) APPARATUS FOR DIVERTING WATER

(71) Applicant: Lon Hugh Sinclair, London (CA)

(72) Inventor: Lon Hugh Sinclair, London (CA)

( * ) Notice: Subject to any disclaimer, the term of this patent is extended or adjusted under 35 U.S.C. 154(b) by 0 days.

(21) Appl. No.: 15/605,384

(22) Filed: May 25, 2017

(65) Prior Publication Data

US 2017/0342716 A1 Nov. 30, 2017

Related U.S. Application Data

(60) Provisional application No. 62/342,734, filed on May 27, 2016.

(51) Int. Cl.
*E04D 13/04* (2006.01)

(52) U.S. Cl.
CPC ..... *E04D 13/0481* (2013.01); *E04D 13/04* (2013.01); *E04D 13/0404* (2013.01); *E04D 13/0409* (2013.01); *E04D 2013/0486* (2013.01)

(58) Field of Classification Search
CPC . E04D 13/04; E04D 13/0404; E04D 13/0409; E04D 13/0431; E04D 13/0459; E04D 13/0481; E04D 13/0445; E04D 2013/0422; E04D 2013/0486; E04D 2013/0813
USPC ..... 52/12
See application file for complete search history.

(56) References Cited

U.S. PATENT DOCUMENTS 4,615,153 A * 10/1986 Carey ..... E04D 13/0645 210/162
5,678,360 A * 10/1997 Fort ..... E04D 13/0645 210/474
5,709,051 A * 1/1998 Mazziotti ..... E04D 13/076 210/162
6,035,580 A * 3/2000 Carter ..... E04D 13/076 210/463
6,170,095 B1 * 1/2001 Zars ..... E04H 4/1236 4/504
6,584,733 B2 * 7/2003 Wade ..... E04D 13/0767 52/12
7,246,472 B2 * 7/2007 Nielsen ..... E03F 5/0406 4/301
8,272,170 B2 * 9/2012 Argentina ..... E04D 13/0645 52/11
2002/0152691 A1 * 10/2002 Wade ..... E04D 13/0767 52/11
2006/0000153 A1 * 1/2006 Banks ..... E04D 13/0431 52/11
2008/0138156 A1 * 6/2008 Janesky ..... E03F 1/002 405/40

FOREIGN PATENT DOCUMENTS

GB 2132657 A * 7/1984 ..... E04D 13/08

* cited by examiner

*Primary Examiner* — Babajide A Demuren
(74) *Attorney, Agent, or Firm* — Perry + Currier

(57) ABSTRACT

An apparatus for and method of diverting water is provided. The apparatus includes a contoured bottom configured to engage a roofing surface, a backwall extending from the contoured bottom and first and second sidewalls extending from the contoured bottom. The method involves using the apparatus to engage a roofing surface, receive a flow of water, direct the flow of water, and drain the flow of water through an opening.

17 Claims, 5 Drawing Sheets

APPARATUS FOR DIVERTING WATER

FIELD

The present specification relates generally to water diverters, and more particularly to an apparatus for diverting water to a location or around obstacles.

BACKGROUND

Roofing structures can be sloped so that water, such as rainwater, can flow off the roof into a gutter system or directly onto the ground. This reduces the accumulation of water on the roof, which can lead to leaks as water permeates through the roofing structure. Accordingly, the sloped roofing structure serves to remove water from the roof.

Roofing structures often include valleys. In the valley areas of a sloped roofing structure, water is collected from two or more sloped roofing planes or elevations, causing a large volume of water to flow down the valley and into a gutter system, directly onto a lower elevation of the sloped roofing structure, or directly off the roof. In some roofing structures, the valleys can include flashing material extending the length of the valley. The outer edges of the flashing material would also typically be overlapped with the roofing material, such as asphalt shingles, sheet metal, slate, or clay tiles.

Roofing structures also generally have protrusions along a plane. For example, protrusions can include structural walls, chimneys, skylights, mechanical equipment, frames, vents, or any other device or elements that are mounted onto or built into the sloped roofing structure. As water flows down a sloped roofing plane, the protrusions will impede the flow of water causing water to collect against the protrusion and eventually flow around it.

When the flow of water through the valley is heavy, such as from a heavy rainfall, the water can overflow, overshoot, or bypass the gutter system. This causes a condition where water flows directly to the ground and potentially onto people. Alternatively, the falling water can cause damage and/or excessive wear and tear or erosion of property or ground below the valley. For example, the flow of water from the valley can discharge directly onto the ground or a lower elevation roofing material causing unsightly staining or premature aging and deterioration of the surface and possible rotting of the substructure below the surface. Similarly, excessive water flow against the wall of a protrusion will accelerate the degradation of the element that protrudes from the roofing structure.

SUMMARY

In accordance with an aspect of the invention, there is provided an apparatus for diverting water. The apparatus includes a contoured bottom configured to engage a roofing surface. The apparatus further includes a backwall extending from the contoured bottom. The back wall is disposed at a downstream end of the contoured bottom and having an opening for water to pass therethrough. In addition, the apparatus includes a first sidewall extending from the contoured bottom. The apparatus also includes a second sidewall extending from the contoured bottom. The second sidewall is opposite the first sidewall, wherein the first sidewall and the second sidewall are configured to direct a flow of water through the opening.

The apparatus may also include a top cover connected to the first side wall, second sidewall and the backwall to form cavity for receiving the flow of water.

The backwall may be contoured to direct the flow of water toward the opening.

The apparatus may also include a base flange extending from the contoured bottom. The base flange may be configured to attached to the roofing surface to reduce leakage.

The base flange may be configured to be inserted under roofing material.

The roofing material may be flashing.

The roofing material may be asphalt shingles.

The apparatus may also include a screen extending between the first sidewall and the second sidewall, wherein the screen is configured to stop debris from reaching the opening.

The screen may be removeable for cleaning.

The apparatus may also include a drainpipe connected to the opening extending away from the backwall.

The drainpipe may include an elbow for changing the direction of the flow of water.

The drainpipe may divert water into a gutter system.

The drainpipe may divert water into a downspout of the gutter system.

The contoured bottom, the backwall, the first sidewall, and the second sidewall may be formed from a unitary molded structure.

In accordance with an aspect of the invention, there is provided a method of diverting water. The method involves engaging a roofing surface with a contoured bottom. The method also involves receiving a flow of water over the contoured bottom. In addition, the method involves directing the flow of water to a backwall using a first sidewall extending from the contoured bottom a second sidewall extending from the contoured bottom. The second sidewall opposite the first sidewall. The method further involves draining water through an opening in a backwall, the backwall extending from the contoured bottom and disposed at a downstream end of the contoured bottom.

The method may also involve directing the flow of water toward the opening using contours of the backwall.

Engaging the roof surface may involve inserting a base flange under roofing material, the base flange extending from the contoured bottom.

The method may also involve stopping debris from reaching the opening using a screen.

The method may involve changing the direction of the flow of water using a drainpipe.

Changing the direction may divert the flow of water into a gutter system.

BRIEF DESCRIPTION OF THE DRAWINGS

Reference will now be made, by way of example only, to the accompanying drawings in which.

DETAILED DESCRIPTION OF THE EMBODIMENTS

As used herein, any usage of terms that suggest an absolute orientation (e.g. "top", "bottom", "front", "back", "up", "down", etc.) are for illustrative convenience and refer to the orientation shown in a particular figure. However, such terms are not to be construed in a limiting sense as it is contemplated that various components will, in practice, be utilized in orientations that are the same as, or different than those described or shown.

Figure 1:
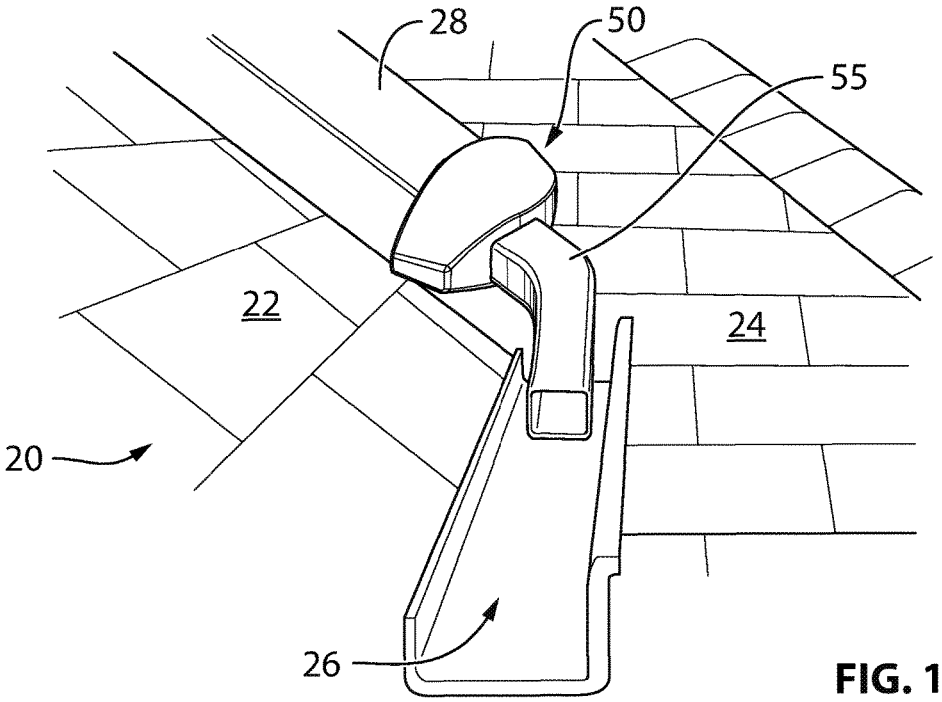
FIG. 1 is a perspective view of a roofing structure with an apparatus in accordance with an embodiment.

Referring to FIG. 1, a representation of a roofing structure is generally shown at 20 with an apparatus 50 for diverting water into a drainpipe 55. It is to be understood that the roofing structure 20 is purely exemplary and that it will be apparent to those skilled in the art that a variety of roofing structures are contemplated where water can be diverted. In the present embodiment, the roofing structure 20 includes a surface having planes 22 and 24. The plane 22 slopes downward toward a gutter 26 for collecting water. The plane 22 is connected to plane 24 to form a valley covered by flashing 28. In other embodiments, the roofing structure 20 can be different and include more or less valleys as well as different orientations or numbers of the planes. In further embodiments, the roofing structure 20 can be modified to include curved surfaces instead of planes as well.

In the present embodiment, the planes 22 and 24 are generally configured to provide shelter and shield the space under the roofing structure 20 from the elements, which can include rain and other forms of precipitation. The planes 22 and 24 are sloped to allow any water falling on the roofing structure 20 to flow off the roofing structure 20 and into the gutter 26 or otherwise off the planes 22 and 24. In terms of providing shelter, the roofing structure 20 is mechanically engineered to support the weight of the roofing structure 20 as well as any additional weight to which the roofing structure 20 may be subjected, such as additional components like solar panels, skylights, and vent fans. The materials from which the planes 22 and 24 are not particularly limited. In the present embodiment, the surface of the planes 22 and 24 are asphalt shingles. In other embodiments, the planes can be sheet metal, slate, clay tiles, galvanized metal, rustproof metal, corrosion resistant metal, molded resin-impregnated fiberglass, polymer, compressed-molded polymer, copper, molded ceramic or other material used for roofing.

The flashing 28 is generally configured to protect the joint between the planes 22 and 24 from water penetration. FIG. 1 illustrates an open valley design where the flashing 28 is placed directly over the joint and the asphalt shingles overlap the edge of the flashing 28. It is to be appreciated by a person of skill in the art with the benefit of this description that other designs are contemplated. For example, the flashing 28 can be substituted with asphalt shingles placed over the valley in a closed valley design. The flashing 28 is not particularly limited and can include flashing made from a wide variety materials. In the present embodiment, the flashing 28 is a metal flashing such as aluminum, lead, copper, stainless steel, or zinc alloy. In other embodiments, the flashing 28 can be plastic, rubber or impregnated paper or omitted in closed valley designs.

The gutter 26 is generally configured to collect water flowing down from the plane 22. The gutter is not particularly limited and can include many different designs and materials. For example, the gutter 26 can be made from aluminum, sheet metal, or plastic. The gutter 26 is part of a gutter system typically leads to a downspout (not shown) where water collected in the gutter 26 is drained, for example, to the ground.

Figure 2A:
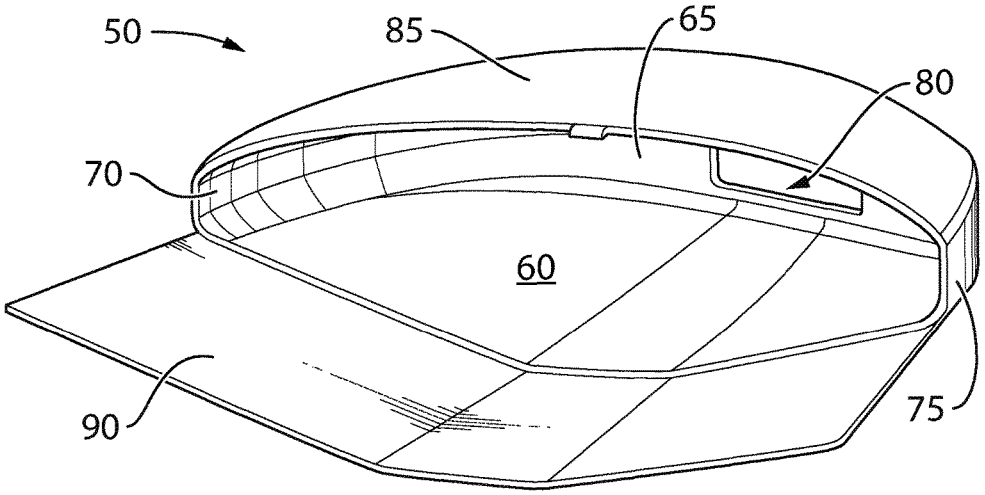
FIGS. 2*a-b* are perspective views of the apparatus in FIG. 1.
Figure 2B:
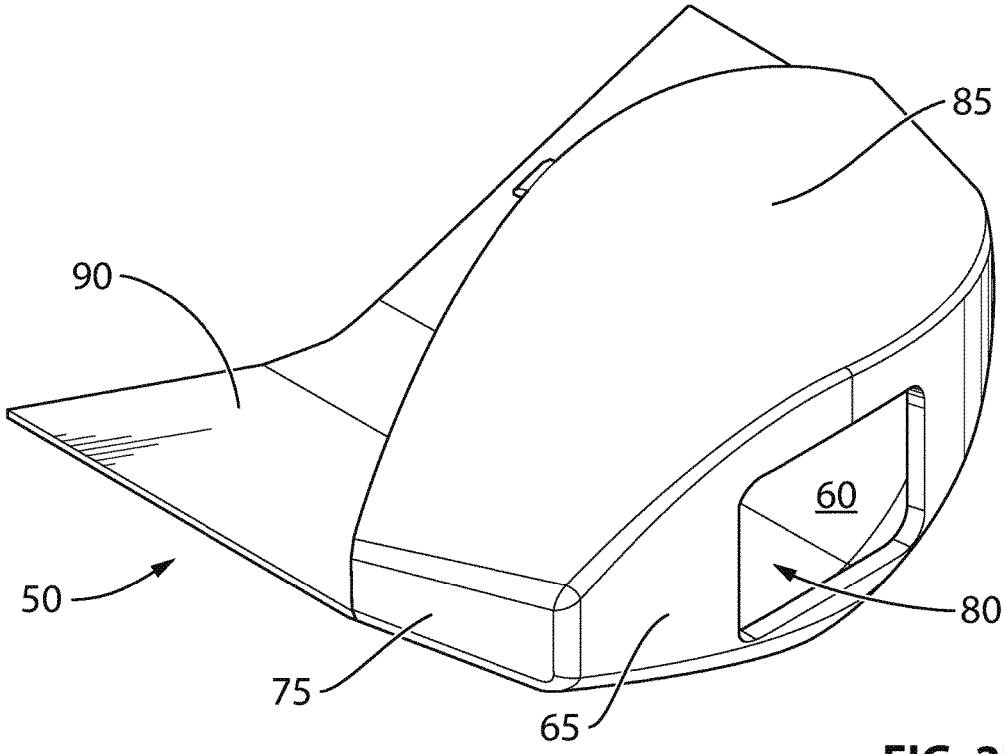

Referring to FIGS. 2*a* and 2*b*, an embodiment of the apparatus 50 for diverting water is shown in greater detail. It is to be understood that the apparatus 50 is purely exemplary and that it will be apparent to a person of skill in the art that variations are contemplated including other embodiments described in greater detail below. The apparatus 50 includes a contoured bottom 60, a backwall 65, and sidewalls 70 and 75 opposite of each other.

The contoured bottom 60 is generally configured to engage the surface of the roofing structure 20. In the present embodiment, the contoured bottom 60 is configured to engage the flashing 28 such that the apparatus 50 can collect water flowing down along the flashing 28. In particular, it is to be appreciated by a person of skill that the contoured bottom 60 is designed to engage the surface as flush as possible so that water would flow into the funnel portion of the apparatus 50 instead of through gaps under the contoured bottom 60. It is to be appreciated by a person of skill in the art with the benefit of this description that the exact shape of the contoured bottom 60 is not particularly limited. For example, the angle of the valley between the planes 22 and 24 can vary and be any value. Accordingly, the contoured bottom 60 can be custom designed to fit any flashing design. In other embodiments, the contoured bottom 60 can engage another portion of the roofing surface such as in front of a protrusion as described in greater detail below. In some embodiments, the contoured bottom 60 can be designed with a finite number of standard shapes, such as flashing angles, for easy installation in common roofing structure 20 designs.

The backwall 65 extends from the contoured bottom 60 and is disposed at the downstream end of the contoured bottom 60 when water is flowing over the contoured bottom 60. In the present embodiment, the backwall 65 is substantially straight and perpendicular to the contoured bottom 60; however, it is to be appreciated that the exact angle of the backwall 65 is not particularly limited. In some embodiments, the backwall 65 can be configured to be at a smaller or larger angles. In other embodiments, the backwall 65 can be configured to be substantially perpendicular to the ground or vertical (i.e. aligned with the force of gravity) when the apparatus 50 is installed on a sloped roofing structure 20. Furthermore, in other embodiments, the backwall 65 can be contoured or curved to direct the flow of water toward an opening 80.

In the present embodiment, the backwall 65 further includes an opening 80 for water to flow therethrough. It is to be appreciated by a person of skill in the art with the benefit of this description that the opening 80 is not particularly limited and can include a wide variety of shapes and sizes. For example, the opening can be a square, rectangle or circle configured to mate with standard drainpipes. In the present embodiment, the opening 80 is a simple hole configured to receive and connect the optional drainpipe 55, which extends away from the backwall 65 such that water flows through the drainpipe 55 to the gutter 26 as shown in FIG. 1.

In the present embodiment, the optional drainpipe 55 can then be connected to the opening 80 using a friction fit, adhesives, mechanical, or any other suitable means. In other embodiments, the drainpipe 55 can also be molded as part of the apparatus 50. The drainpipe 55 of the present embodiment is an elbow in the present embodiment and can be either custom designed, or a standard part available from retail stores. It is appreciated by a person of skill in the art that the elbow can be configured to change the direction of the flow of water. For example, as shown in FIG. 1, the elbow receives water flowing along the flashing 28 in the valley and redirects the flow into the gutter 26. In other examples, the optional drainpipe 55 can be used to divert water directly into the downspout (not shown) of the gutter system.

In other embodiments, the opening 80 can include a coupling mechanism to couple with hosing or another drainpipe. For example, the opening 80 can have a threaded connector, a quick connect connector, or any other type of suitable connector.

The sidewalls 70 and 75 extend from the contoured bottom 60 and are opposite of each other as shown in FIG. 2*a*. In the present embodiment, the sidewalls 70 and 75 are generally parallel to each other, but it is appreciated that other configurations are contemplated. For example, the sidewalls 70 and 75 can form a wedge shape to funnel water toward the opening 80. In general, the sidewalls 70 and 75 are generally configured to direct a flow of water toward the backwall 65 and subsequently through the opening 80.

In the present embodiment, the apparatus 50 further includes an optional top cover 85 connected to the sidewalls 70 and 75 as well as the backwall 65 to form a cavity for receiving a flow of water. It is to be appreciated that the top cover 85 forms a funnel-like structure that is generally configured to receive water at a large opening and direct the water to pass through the opening 80, which is generally smaller. It will become apparent to a person of skill in the art with the benefit of this description that the optional top cover 85 provides additional protection for the apparatus 50. For example, the top cover 85 can protect the apparatus from debris such as leaves that may fall onto the contoured bottom 60 and clog the opening 80. In addition, the top cover 85 can reduce likelihood of overloading the apparatus and having water spill over the backwall 65 and/or the sidewalls 70 and 75.

Furthermore, the present embodiment also includes an optional base flange 90 that extends from the contoured bottom 60. The base flange 90 is generally configured to attach to the surface of the roofing structure 20 to further reduce water leakage underneath the contoured bottom 60. For example, the base flange 90 can be inserted underneath roofing material such as the flashing 28 or asphalt shingles. It is to be appreciated by a person of skill in the art that by overlapping the base flange 90 with the flashing 28 or asphalt shingles, any water flowing toward the apparatus 50 will flow from the roofing material to over the base flange 90 and subsequently over the contoured bottom 60 and through the opening 80. It is to be understood that the material of the base flange 90 is not particularly limited to any specific material and that several materials are contemplated. Some suitable materials include the same materials used for the contoured bottom 60, such as various plastics or metal. It is to be appreciated that the base flange 90 can be a separate part connected to the contoured bottom 60 or an extension of the contoured bottom 60.

In use, the present embodiment of the invention is generally configured to collect flowing water and divert the flowing water into the gutter. The apparatus 50 receives the flowing water from a valley on the roofing structure between the sidewalls 70 and 75 and allows the water to flow over the contoured bottom 60 to the backwall 65. The backwall 65 slows the flow of water, but allows the water to flow through the opening at a controlled rate into the optional drainpipe 55 in a controlled manner.

It is to be re-emphasized that the structure shown in FIGS. 2*a* and 2*b* is a non-limiting representation only and that variations are contemplated. For example, it is to be appreciated that one or more components, such as the contoured bottom 60, the backwall 65, the sidewalls 70 and 75, the top cover 85, and the base flange 90 can be formed as a single unitary piece. For example, the entire apparatus 50 can be formed using injection molding, compression molding, or other forming techniques. Alternatively, each of the contoured bottom 60, the backwall 65, the sidewalls 70 and 75, the top cover 85, and the base flange 90 can be individually formed and joined together using adhesives or other fasteners. It is to be appreciated by a person of skill in the art that the material used for any of the components of the apparatus 50 is not particularly limited. In the present embodiment, the apparatus 50 is constructed from a plastic, such as a polymer. Other suitable materials include metals, such as gavalnized metal, rustproof metal, corrosion resistant metals, molded resin-impregnated fiberglass, copper, ceramic materials, and clay.

Figure 3:
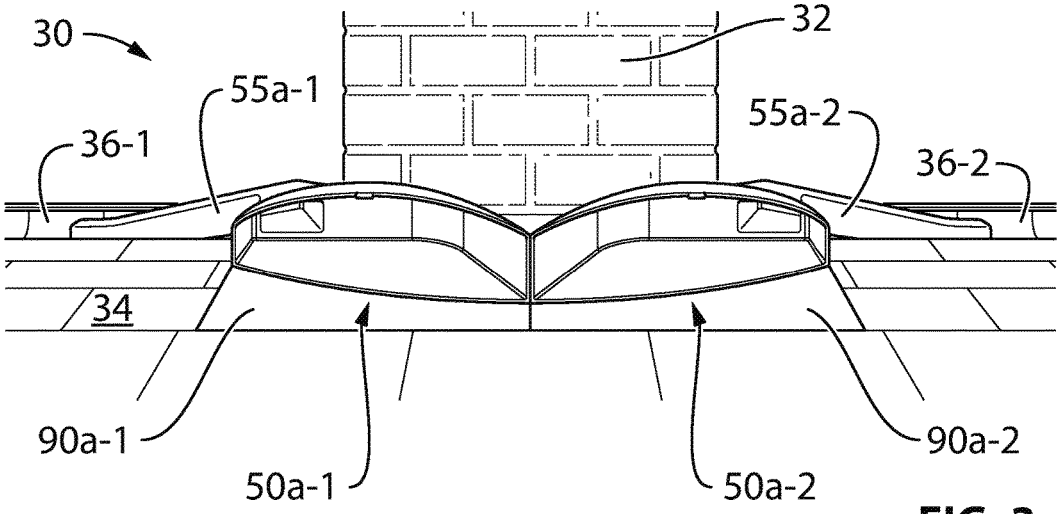
FIG. 3 is a perspective view of another roofing structure with an apparatus in accordance with another embodiment.

Referring to FIG. 3, a representation of another roofing structure is generally shown at 30 with apparatus 50*a*-1 and apparatus 50*a*-2 (generically, these apparatus are referred to herein as "apparatus 50*a*" and collectively they are referred to as "apparatus 50*a*", this nomenclature is used elsewhere in this description) having drainpipes 55*a*-1 and 55*a*-2, respectively, for diverting water around a protrusion 32. Like components of the apparatus 50*a*-1 and apparatus 50*a*-2 bear like reference to their counterparts in the apparatus 50, except followed by the suffix "a". In the present embodiment, the roofing structure 30 includes a surface 34. The surface 34 slopes downward toward gutters 36-1 and 36-2 for collecting water as well as the protrusion 32, which in this case is a wall of a chimney.

In the present embodiment, the surface 34 slopes toward the protrusion 32. During precipitation, water would generally flow toward the protrusion 32 and against the wall. It is to be appreciated by a person of skill in the art with the benefit of this description that the force of the flow of water would accelerated the wear on the wall of the protrusion 32. In addition, the wall of the protrusion 32 forms a joint with the surface 34 which may be susceptible to water penetration when exposed to water flow over long periods of time.

The apparatus 50*a*-1 and apparatus 50*a*-2 are placed adjacent to each other in the present embodiment to cover a wider area in front of the protrusion 32. It is to be appreciated by a person of skill in the art that although two apparatus 50*a*-1 and 50*a*-2 are used to span the width of the protrusion 32 in the present example, a single apparatus of sufficient width can be used as a substitute. Alternatively, more than two apparatus can be used if the protrusion 32 was wider than two of the apparatus 50*a*.

Figure 4A:
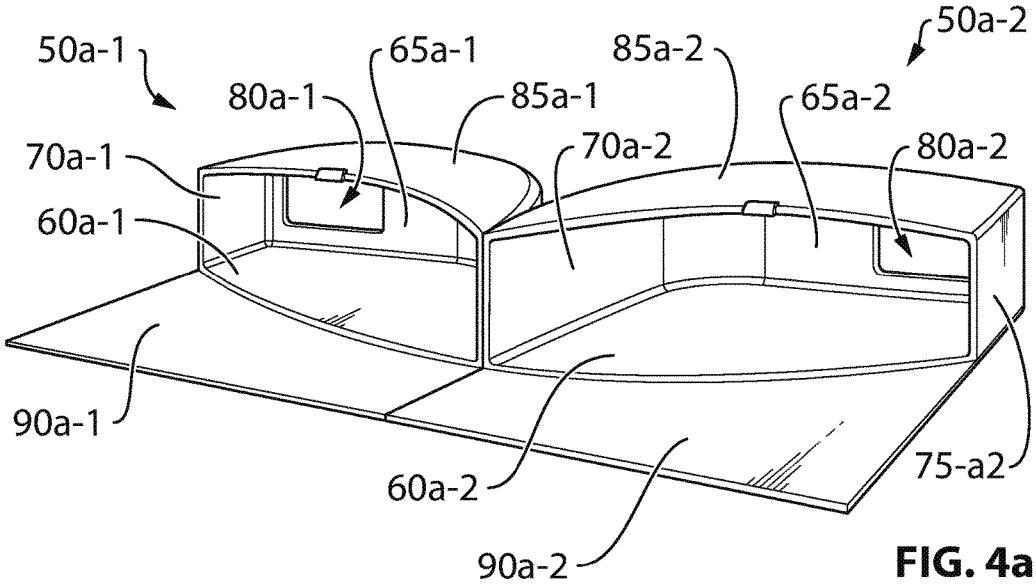
FIGS. 4*a-b* are perspective views of the apparatus in FIG. 3.
Figure 4B:
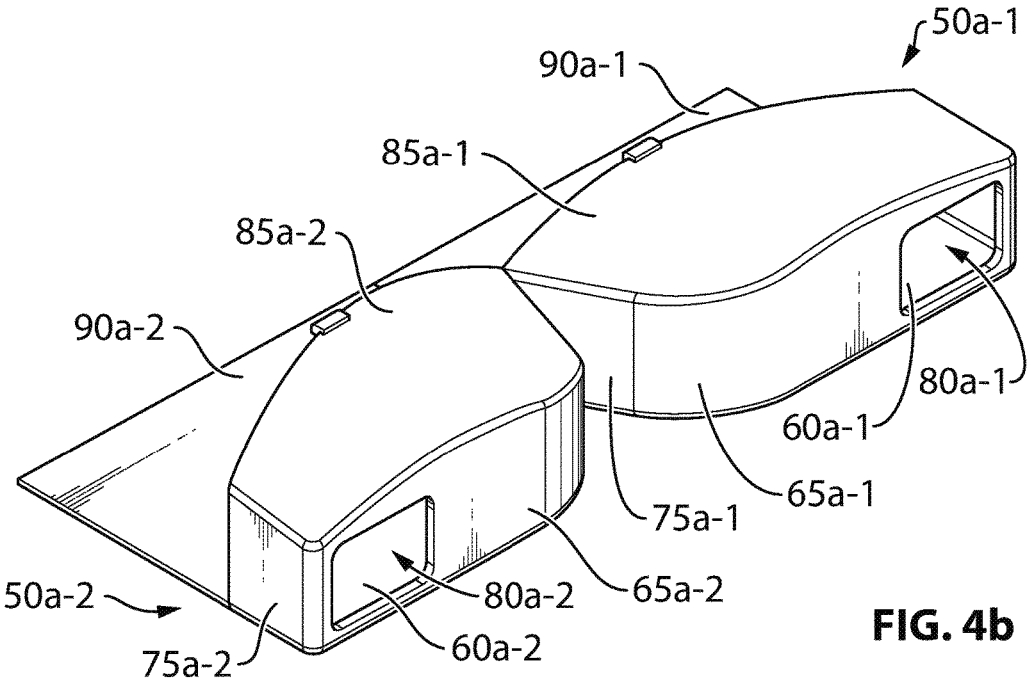

Referring to FIGS. 4*a* and 4*b*, an embodiment of the apparatus 50*a*-1 and apparatus 50*a*-2 for diverting water is shown in greater detail. The apparatus 50*a*-1 includes a contoured bottom 60*a*-1, a backwall 65*a*-1 having an opening 80*a*-1, and sidewalls 70*a*-1 and 75*a*-1 opposite of each other. In the present embodiment, the apparatus 50*a*-1 also includes the optional top cover 85*a*-1 and the optional base flange 90*a*-1. The apparatus 50*a*-2 includes a contoured bottom 60*a*-2, a backwall 65*a*-2 having an opening 80*a*-2, and sidewalls 70*a*-2 and 75*a*-2 opposite of each other. In the present embodiment, the apparatus 50*a*-2 also includes the optional top cover 85*a*-2 and the optional base flange 90*a*-2.

In use, the present embodiment of the invention is generally configured to collect flowing water and divert the flowing water around the protrusion 32 and into the gutters 36-1 and 36-2. The apparatus 50*a*-1 and apparatus 50*a*-2 each receives the flowing water from the surface 34 of the roofing structure 30 and redirects it to the gutters 36-1 and 36-2, respectively.

Figure 5:
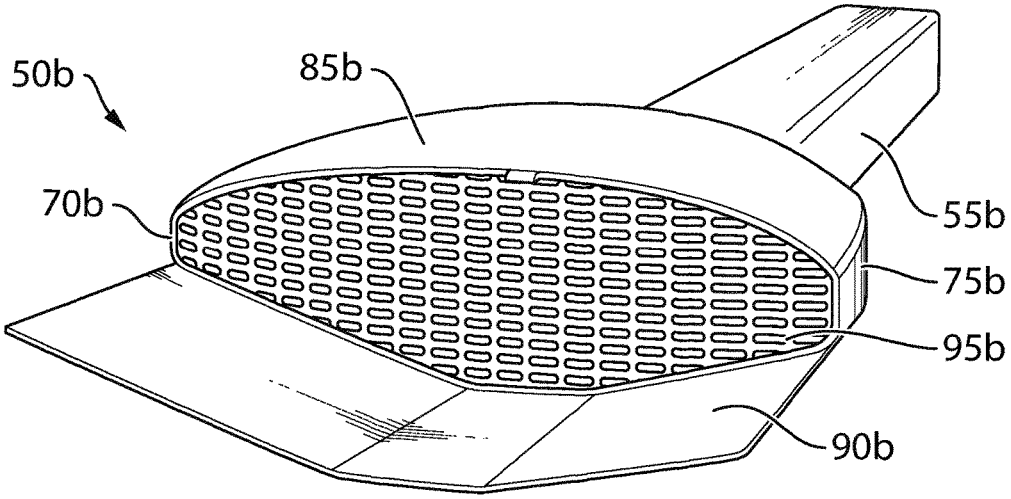
FIG. 5 is a perspective view of an apparatus in accordance with another embodiment.

Referring to FIG. 5, an embodiment of the apparatus 50*b* for diverting water is shown. Like components of the apparatus 50*b* bear like reference to their counterparts in the apparatus 50, except followed by the suffix "b". The apparatus 50*b* includes similar features as the apparatus 50 including sidewalls 70*b* and 75*b* opposite of each other, the optional top cover 85*b*, and the optional base flange 90*b*. As shown, the apparatus 50*b* is also connected to a drainpipe 55*b*. In the present embodiment, the apparatus 50*b* also includes a screen 95*b* that extends between the sidewall 70*b* to the sidewall 75*b* and from top cover 85*b* to base flange 90*b* covering the entire opening.

The screen 95*b* is generally configured to stop debris from reaching the opening on the backwall (not shown in FIG. 5). In the present embodiment, the screen 95*b* is also removeable to provide for easy cleaning of the screen 95*b* as well as the apparatus 50*b*. The manner by which the screen 95*b* is secured to the apparatus is not particularly limited. For example, the screen can be secured using removeable clips, magnets, or fasteners such as screws or bolts. In other embodiment, the screen 95*b* can be permanently attached to the other parts of the apparatus 50*b* using adhesives or be unitarily formed with sidewalls 70*b* and 75*b*.

It is to be appreciated by a person of skill in the art with the benefit of this description would recognize that the materials from which the screen 95*b* is made is not particularly limited. The screen 95*b* would need to be constructed from a weatherproof material with sufficient mechanical strength to stop debris from entering the apparatus 50*b*. Some examples of suitable materials include metal, and plastic. In addition, the size of the holes in the screen 95*b* is not particularly limited. It is to be understood that the size of the holes can also vary depending on the specific environment where the apparatus is to be deployed and the size of the expected debris.

Figure 6:
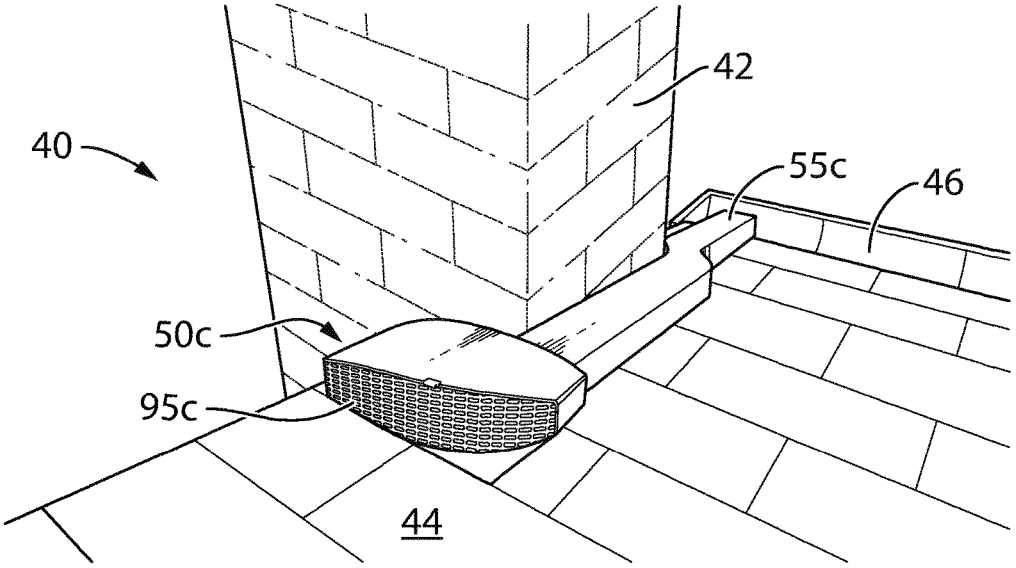
FIG. 6 is a perspective view of another roofing structure with an apparatus in accordance with another embodiment.

Referring to FIG. 6, a representation of another roofing structure is generally shown at 40 with apparatus 50*c* having a drainpipes 55*c* for diverting water around a protrusion 42. Like components of the apparatus 50*c* bear like reference to their counterparts in the apparatus 50*b*-2, except followed by the suffix "c". In the present embodiment, the roofing structure 40 includes a surface 44. The surface 44 slopes downward toward gutter 46 for collecting water as well as a portion of the protrusion 42, which in this case is a wall of a chimney. It is to be appreciated that the apparatus 50*c* functions substantially similar to the apparatus 50*b*-2.

Figure 7:
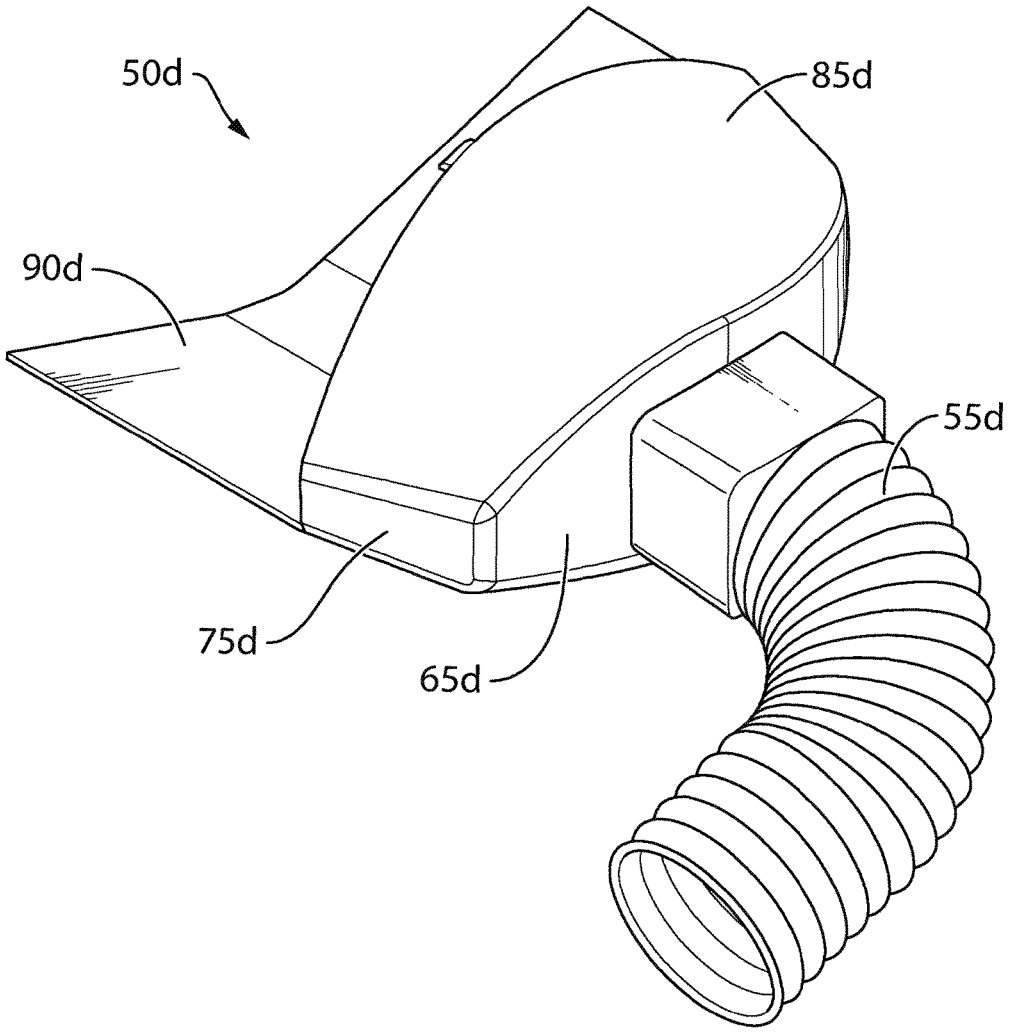
FIG. 7 is a perspective view of an apparatus in accordance with another embodiment.

Referring to FIG. 7, an embodiment of the apparatus 50*d* for diverting water is shown. Like components of the apparatus 50*d* bear like reference to their counterparts in the apparatus 50, except followed by the suffix "d". The apparatus 50*d* includes similar features as the apparatus 50 including a backwall 65*d*, sidewall 75*d*, the optional top cover 85*d*, and the optional base flange 90*d*. In the present embodiment, the apparatus 50*b* also includes a flexible drainpipe 55*d*. The flexible drainpipe 55*d* is generally configured to provide an adjustable diverter where the water can be diverted to various locations.

Various advantages will now be apparent. Of note is the ability to direct water into a gutter system without overflowing the gutter system that receives a substantial amount of water from an angle. In addition, the invention can reduce excessive wear and tear, such as staining, discoloring, and premature aging, on various roofing structures or property below roofing structures caused by excessive water flow or erosion.

While specific embodiments have been described and illustrated, such embodiments should be considered illustrative only and should not serve to limit the accompanying claims.

What is claimed is:

1. An apparatus for diverting water, the apparatus comprising:

a contoured bottom configured to engage a roofing surface;

a backwall extending from the contoured bottom, the backwall disposed at a downstream end of the contoured bottom and having an opening for water to pass therethrough;

a first sidewall extending from the contoured bottom;

a base flange extending from the contoured bottom, wherein the base flange is to be inserted under a roofing material such that the base flange is to attach to the roofing surface, wherein the roofing material is to overlap the base flange on a plane to reduce leakage; and a second sidewall extending from the contoured bottom, the second sidewall opposite the first sidewall, wherein the first sidewall and the second sidewall are configured to direct a flow of water through the opening.

2. The apparatus of claim 1, further comprising a top cover connected to the first sidewall, second sidewall and the backwall to form cavity for receiving the flow of water.

3. The apparatus of claim 1, wherein the backwall is contoured to direct the flow of water toward the opening.

4. The apparatus of claim 1, wherein the roofing material is flashing.

5. The apparatus of claim 1, wherein the roofing material is asphalt shingles.

6. The apparatus of claim 1, further comprising a screen extending between the first sidewall and the second sidewall, wherein the screen is configured to stop debris from reaching the opening.

7. The apparatus of claim 6, wherein the screen is removeable for cleaning.

8. The apparatus of claim 1, further comprising a drainpipe connected to the opening extending away from the backwall.

9. The apparatus of claim 8, wherein the drainpipe includes an elbow for changing a direction of the flow of water.

10. The apparatus of claim 8, wherein the drainpipe diverts water into a gutter system.

11. The apparatus of claim 10, wherein the drainpipe diverts water into a downspout of the gutter system.

12. The apparatus of claim 1, wherein the contoured bottom, the backwall, the first sidewall, and the second sidewall are formed from a unitary molded structure.

13. A method of diverting water, the method comprising:

engaging a roofing surface with a contoured bottom, wherein engaging the roof surface comprises inserting a base flange under a roofing material to attach the base flange to the roofing surface wherein the base flange extends from the contoured bottom, and wherein the roofing material overlaps the base flange on a plane to reduce leakage;

receiving a flow of water over the contoured bottom;

directing the flow of water to a backwall using a first sidewall extending from the contoured bottom a second sidewall extending from the contoured bottom, the second sidewall opposite the first sidewall; and draining water through an opening in a backwall, the backwall extending from the contoured bottom and disposed at a downstream end of the contoured bottom.

14. The method of claim 13, further comprising directing the flow of water toward the opening using contours of the backwall.

15. The method of claim 13, further composing stopping debris from reaching the opening using a screen.

16. The method of claim 13, further comprising changing a direction of the flow of water using a drainpipe.

17. The method of claim 16, wherein changing a direction diverts the flow of water into a gutter system.

* * * * *